US006840401B2

(12) United States Patent
Amundson

(10) Patent No.: US 6,840,401 B2
(45) Date of Patent: Jan. 11, 2005

(54) MULTIPLE LAYER BAFFLE STRUCTURE FOR DISPENSER FOR WIPES

(75) Inventor: John David Amundson, West Sussex (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 69 days.

(21) Appl. No.: 10/326,337

(22) Filed: Dec. 19, 2002

(65) Prior Publication Data

US 2004/0118862 A1 Jun. 24, 2004

(51) Int. Cl.[7] ..... B65H 1/08
(52) U.S. Cl. ..... 221/56; 206/494
(58) Field of Search ..... 221/33, 45, 46, 221/48, 49, 56, 63, 303; 206/494, 449, 554, 812

(56) References Cited

U.S. PATENT DOCUMENTS

| | | | | |
|---|---|---|---|---|
| 2,004,614 A | | 6/1935 | Meagher | |
| 3,095,991 A | | 7/1963 | Paniagua | |
| 3,207,360 A | * | 9/1965 | Scott | 221/48 |
| 3,239,097 A | | 3/1966 | Bates et al. | |
| 3,266,665 A | | 8/1966 | Eakens | |
| 3,266,666 A | * | 8/1966 | Nelson | 221/48 |
| 3,369,699 A | | 2/1968 | Enloe et al. | |
| 3,401,928 A | | 9/1968 | Frick | |
| 3,462,043 A | | 8/1969 | Frick | |
| 3,473,694 A | | 10/1969 | Murphy et al. | |
| 3,749,296 A | | 7/1973 | Harrison | |
| 3,780,908 A | | 12/1973 | Fitzpatrick et al. | |
| 3,836,044 A | | 9/1974 | Tilp et al. | |
| 3,841,466 A | | 10/1974 | Hoffman et al. | |
| 3,868,052 A | | 2/1975 | Rockefeller | |
| 3,979,019 A | | 9/1976 | Bliss | |
| 3,986,479 A | | 10/1976 | Bonk | |

(List continued on next page.)

FOREIGN PATENT DOCUMENTS

| | | |
|---|---|---|
| DE | 29705157 U1 | 12/1997 |
| DE | 94 55 185 U1 | 9/1998 |

(List continued on next page.)

OTHER PUBLICATIONS

American Society for Testing Materials (ASTM) Designation: D 412–98a, "Standard Test Methods for Vulcanized Rubber and Thermoplastic Elastomers—Tension," pp. 43–55, published Aug. 1998.

(List continued on next page.)

*Primary Examiner*—Kenneth Noland
(74) *Attorney, Agent, or Firm*—Michael J. Bendel; Scott A. Baum

(57) ABSTRACT

There is provided a multiple layer baffle structure for dispensing a wipe therethrough. The structure includes at least a first layer having a first length and a first width and a first dispensing orifice; and, at least a second layer having a second length and a second width and a second dispensing orifice, where the first layer is disposed over the second layer and at least partially contacts the second layer proximate the dispensing orifices and the first layer is distinct from the second layer so as to be movable relative to the second layer and the wipe may be dispensed sequentially through the first dispensing orifice and the second dispensing orifice.

38 Claims, 12 Drawing Sheets

U.S. PATENT DOCUMENTS

| | | | | |
|---|---|---|---|---|
| 3,994,417 | A | * 11/1976 | Boedecker | 221/48 |
| 4,002,264 | A | 1/1977 | Marchesani | |
| 4,004,687 | A | 1/1977 | Boone | |
| 4,017,002 | A | 4/1977 | Doyle et al. | |
| 4,100,324 | A | 7/1978 | Anderson et al. | |
| 4,131,195 | A | 12/1978 | Worrell, Sr. | |
| 4,133,457 | A | 1/1979 | Klassen | |
| 4,138,034 | A | 2/1979 | McCarthy | |
| 4,180,160 | A | 12/1979 | Ogawa et al. | |
| 4,185,754 | A | 1/1980 | Julius | |
| 4,191,230 | A | 3/1980 | Ausnit | |
| 4,200,200 | A | 4/1980 | Hein et al. | |
| 4,252,238 | A | 2/1981 | Spiegelberg et al. | |
| 4,285,376 | A | 8/1981 | Ausnit | |
| 4,289,262 | A | 9/1981 | Finkelstein | |
| D263,283 | S | 3/1982 | Ronayne | |
| 4,337,876 | A | 7/1982 | Thompson | |
| 4,478,354 | A | 10/1984 | Notheis | |
| 4,535,912 | A | 8/1985 | Bonk | |
| 4,540,091 | A | 9/1985 | Habock | |
| 4,550,855 | A | 11/1985 | Harrison | |
| 4,562,938 | A | 1/1986 | Loder | |
| 4,570,820 | A | 2/1986 | Murphy | |
| 4,610,357 | A | 9/1986 | Nakamura | |
| 4,637,061 | A | 1/1987 | Riese | |
| 4,638,921 | A | 1/1987 | Sigl et al. | |
| 4,678,099 | A | 7/1987 | Matsui | |
| 4,681,240 | A | 7/1987 | Wyant | |
| D296,765 | S | 7/1988 | Urion | |
| 4,784,290 | A | 11/1988 | Howard | |
| 4,848,575 | A | 7/1989 | Nakamura et al. | |
| 4,863,064 | A | 9/1989 | Dailey, III | |
| 4,925,316 | A | 5/1990 | Van Erden et al. | |
| 4,934,535 | A | 6/1990 | Muckenfuhs et al. | |
| 5,050,737 | A | 9/1991 | Joslyn et al. | |
| 5,135,134 | A | 8/1992 | Dancy | |
| 5,145,091 | A | 9/1992 | Meyers | |
| 5,285,927 | A | 2/1994 | Pruitt | |
| 5,368,188 | A | 11/1994 | Twardowski | |
| D354,224 | S | 1/1995 | Norton et al. | |
| D354,225 | S | 1/1995 | Norton et al. | |
| 5,415,320 | A | 5/1995 | North et al. | |
| 5,458,259 | A | 10/1995 | Falk | |
| 5,497,903 | A | 3/1996 | Yoneyama | |
| 5,542,567 | A | 8/1996 | Julius | |
| 5,542,568 | A | 8/1996 | Julius | |
| 5,560,514 | A | 10/1996 | Frazier | |
| 5,582,294 | A | 12/1996 | Yamada | |
| 5,601,368 | A | 2/1997 | Bodolay et al. | |
| 5,685,643 | A | 11/1997 | Stary | |
| 5,704,471 | A | 1/1998 | Yamada | |
| 5,704,714 | A | 1/1998 | Stary | |
| 5,729,955 | A | 3/1998 | Yamada | |
| 5,740,913 | A | 4/1998 | McFarland | |
| 5,755,356 | A | 5/1998 | Bastiaens et al. | |
| D395,952 | S | 7/1998 | Buczwinski et al. | |
| 5,785,179 | A | 7/1998 | Buczwinski et al. | |
| D397,938 | S | 9/1998 | Graham et al. | |
| 5,908,138 | A | 6/1999 | Vlahakis et al. | |
| D412,439 | S | 8/1999 | Cormack | |
| D414,637 | S | 10/1999 | Amundson et al. | |
| 6,053,357 | A | 4/2000 | Yoh | |
| 6,079,878 | A | 6/2000 | Yeager | |
| D430,455 | S | 9/2000 | Pickens | |
| 6,152,322 | A | 11/2000 | Marino | |
| 6,158,614 | A | 12/2000 | Haines et al. | |
| 6,164,442 | A | 12/2000 | Stravitz | |
| 6,182,858 | B1 | 2/2001 | Hartog | |
| 6,269,969 | B1 | 8/2001 | Huang et al. | |
| 6,283,405 | B1 | 9/2001 | Tracy | |
| 6,364,101 | B1 | 4/2002 | Schultz | |
| 6,523,690 | B1 | 2/2003 | Buck et al. | |
| 2002/0096533 | A1 | 7/2002 | Amundson et al. | |
| 2002/0127937 | A1 | 9/2002 | Lange et al. | |
| 2002/0195764 | A1 | 12/2002 | Sosalla | |

FOREIGN PATENT DOCUMENTS

| | | | |
|---|---|---|---|
| EP | 0 096 546 | B1 | 5/1987 |
| EP | 0 068 722 | B1 | 4/1988 |
| EP | 0 302 382 | A1 | 2/1989 |
| EP | 0 286 538 | B1 | 1/1992 |
| EP | 0 331 027 | B1 | 1/1992 |
| EP | 0 410 937 | B1 | 12/1993 |
| EP | 0 644 130 | B1 | 5/1998 |
| EP | 0 747 313 | B1 | 5/1998 |
| EP | 0 952 088 | A1 | 10/1999 |
| EP | 0 955 247 | A1 | 11/1999 |
| EP | 0 980 841 | A2 | 2/2000 |
| EP | 0 983 739 | A2 | 3/2000 |
| EP | 0 983 740 | A2 | 3/2000 |
| EP | 0 744 357 | B1 | 10/2000 |
| EP | 0 900 043 | B1 | 11/2000 |
| EP | 0 784 572 | B1 | 4/2002 |
| FR | 2 831 045 | | 4/2003 |
| GB | 793745 | | 4/1958 |
| GB | 2 106 862 | B | 4/1985 |
| WO | WO 98/29018 | A1 | 7/1998 |
| WO | WO 99/55599 | A1 | 11/1999 |
| WO | WO 00/57843 | A2 | 10/2000 |
| WO | WO 02/41742 | A1 | 5/2002 |
| WO | WO 02/53003 | A2 | 7/2002 |
| WO | WO 02/53365 | A2 | 7/2002 |
| WO | WO 02/58524 | A2 | 8/2002 |

OTHER PUBLICATIONS

American Society for Testing Materials (ASTM) Designation: D 790–99, "Standard Test Methods for Flexural Properties of Unreinforced and Reinforced Plastics and Electrical Insulating Materials," pp. 150–158, published Feb. 2000.

American Society for Testing Materials (ASTM) Designation: D 2240–97, "Standard Test Method for Rubber Property—Durometer Hardness," pp. 400–403, published Mar. 1997.

American Society for Testing Materials (ASTM) Designation: D 6125–97, "Standard Test Method for Bending Resistance of Paper and Paperboard (Gurley Type Tester)," pp. 885–889, published Feb. 1998.

Product bag sold by Kimberly–Clark Corporation under the tradename HUGGIES® Supreme Care Baby Wipes, commerically available at least as early as Jan. 23, 2001.

Patent Cooperation Treaty Search Report from the International Search Authority, International Application No. PCT/US 03/39738 dated Apr. 24, 2004.

* cited by examiner

MULTIPLE LAYER BAFFLE STRUCTURE FOR DISPENSER FOR WIPES

BACKGROUND OF THE INVENTION

Wipes have been made from a variety of materials which may be dry or wet when used. Wet wipes may be moistened with a variety of suitable wiping solutions. Typically, wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which is folded into a stack (e.g., accordion or zigzag like) or wound into a roll. Such wet wipes have been used for baby wipes, hand wipes, household cleaning wipes, industrial wipes and the like.

The conventional packages which contain wipes, such as those described above, have typically been designed to be positioned on a flat surface such as a countertop, changing table or the like. Such conventional packages have generally provided a plastic container, tub or package which provides a sealed environment for the wet wipes to ensure that they do not become overly dry. Some of the conventional packages have also been configured to provide one at a time dispensing of each wet wipe which may be accomplished using a single hand after the package has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the dispensing of wipes from such conventional containers for wipes has not been completely satisfactory. For example, dispensing may be improved by providing a baffle structure with more operating parameters for the dispensing of wipes, one-at-a-time, successfully from the dispenser. As another example, by providing such a new baffle structure with more operating parameters, then a manufacturer has more parameters that may be varied to account for dispensing variability due to different wipe factors. That is, the forces interacting between successive wipes during dispensing (e.g., the composition of the wipe material, the solution moistening the wipe (if any), handling of the wipe during manufacturing, the type of separably joined relationship between adjacent wipes, the folded or unfolded configuration of the wipes, the relationship of one wipe to any adjacent wipes, and the like) may be better accommodated by the new baffle structure so dispensing may be more uniform on each wipe dispensing occasion.

SUMMARY OF THE INVENTION

In response to the difficulties and problems discussed above, for example, a new baffle structure for dispensers for wipes that has improved dispensing and/or improved moisture retention, has been created. Such baffle structure may be used with a variety of conventional dispensers. For example, such is believed to be particularly useful, though not so limited, and builds upon the teaching of while also expanding the scope of use for such a baffle structure, for the package seen in the patent application titled, "STORAGE AND DISPENSING PACKAGE FOR WIPES", filed Jan. 23, 2002 of inventors Amundson et al. and known as published application number WO 02/058524, which is incorporated herein by reference.

The purposes and features of the present invention will be set forth in and are apparent from the description that follows, as well as will be learned by practice of the invention. Additional features of the invention will be realized and attained by the baffle structure and package particularly pointed out in the written description and claims hereof, as well as from the appended drawings.

In one aspect, there is provided a multiple layer baffle structure for dispensing a wipe therethrough. The structure includes at least a first layer having a first length and a first width and a first dispensing orifice. The baffle structure also includes at least a second layer having a second length and a second width and a second dispensing orifice. The first layer is disposed over the second layer and at least partially contacts the second layer proximate the dispensing orifices. The first layer is distinct from the second layer so as to be movable relative to the second layer and the wipe may be dispensed sequentially through the first dispensing orifice and the second dispensing orifice.

In another aspect, the invention provides a baffle structure for dispensing a wipe therethrough. The baffle structure includes at least a first layer having a first length and a first width and a first dispensing orifice. The baffle structure also includes at least a second layer having a second length and a second width and a second dispensing orifice. The first layer at least partially contacts the second layer proximate the dispensing orifices and the first dispensing orifice is disposed at least partially overlying the second dispensing orifice. The first dispensing orifice has a first longitudinal axis oriented in a first direction and the second dispensing orifice has a second longitudinal axis oriented in a second direction. The first direction is non-parallel relative to the second direction, and the wipe may be dispensed therethrough.

In still another aspect, the invention provides a storage and dispensing package for wipes. The package includes a container having sides which define a cavity therein, and a baffle structure having a width and positioned within the sides of the container and dividing the cavity into a storage portion for wipes and a dispensing portion. The baffle structure includes at least a first layer having a first length and a first width and a first dispensing orifice, and at least a second layer having a second length and a second width and a second dispensing orifice. The first layer at least partially contacts the second layer proximate the dispensing orifices and the first dispensing orifice is disposed at least partially overlying the second dispensing orifice. The first dispensing orifice has a first longitudinal axis oriented in a first direction and the second dispensing orifice has a second longitudinal axis oriented in a second direction. The first direction is non-parallel relative to the second direction, and the wipe may be dispensed therethrough and communicate with the dispensing portion.

In other aspects, the invention provides the dispensing orifices having particular characteristics such as type of seal, condition of the seal, and configurations and orientations of the orifices. Such may include the size, shape, and orientation of the dispensing orifices per se and relative to each other, as well as the structure of the layers per se (e.g., made of the same composition of ingredients/processing or different ingredients/processing).

In yet other aspects, the invention provides various baffle structure configurations and orientations. For example, configurations of the baffle structure such as partially spanning the space between the sides of the container to completely spanning that space, separate piece and same piece construction with the container, baffle structure width, the baffle structure relative to wipes in the container, and, orientations such as parallel to wipes included therein.

As with the other packages including the invention, the container and baffle structure may be transparent or translucent to provide an indication of the quantity of wipes remaining in the package. The container and baffle structure may be made of various polymers, copolymers, and mixtures, including, e.g., polyethylene, polypropylene, polyester, polystyrene, and other polymers.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the baffle structures of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

DETAILED DESCRIPTION OF THE INVENTION

Figure 1:
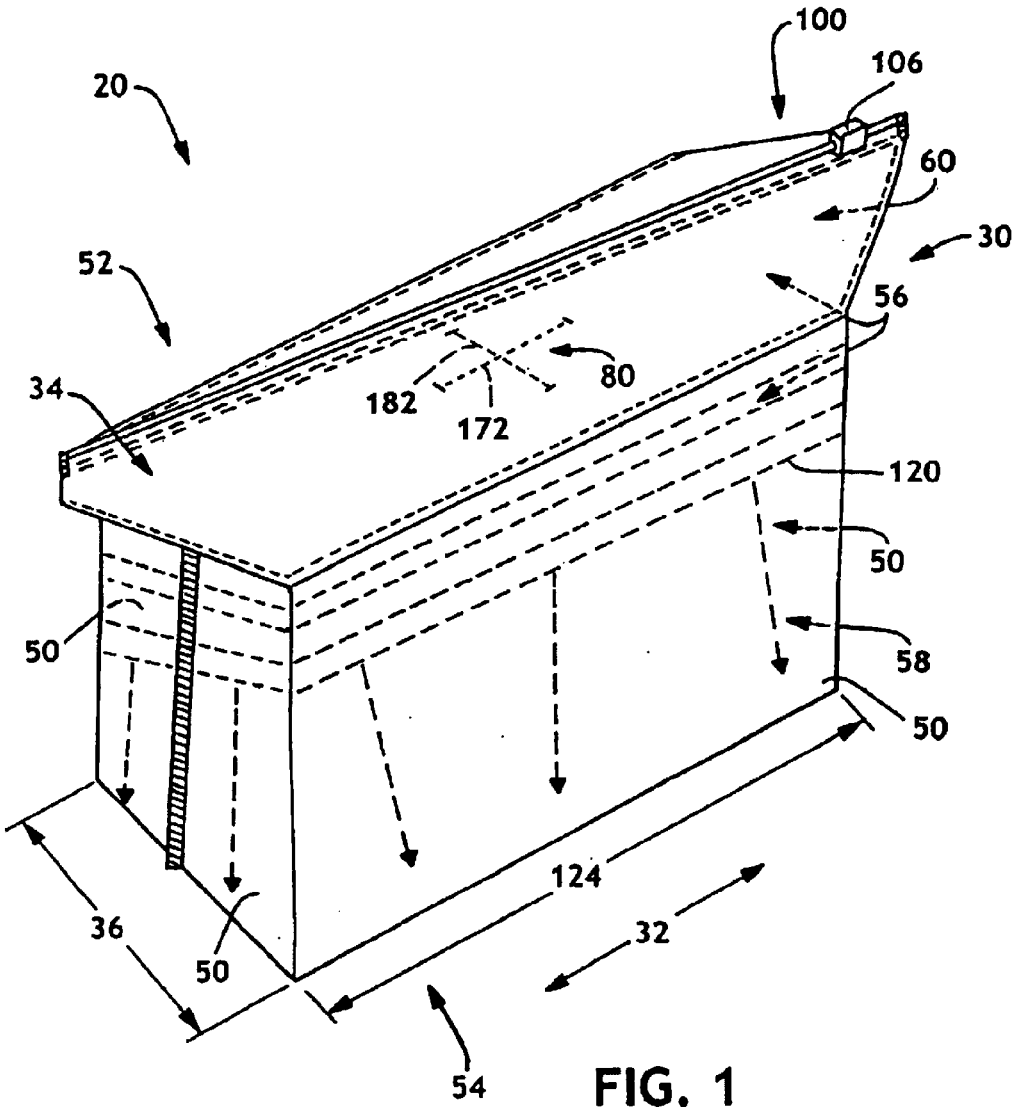
FIG. 1 representatively shows a perspective view of an example of a package for wipes according to the present invention before dispensing any wipes and in a closed position, with wipes and dispensing orifices shown in phantom inside the package.
Figure 1A:
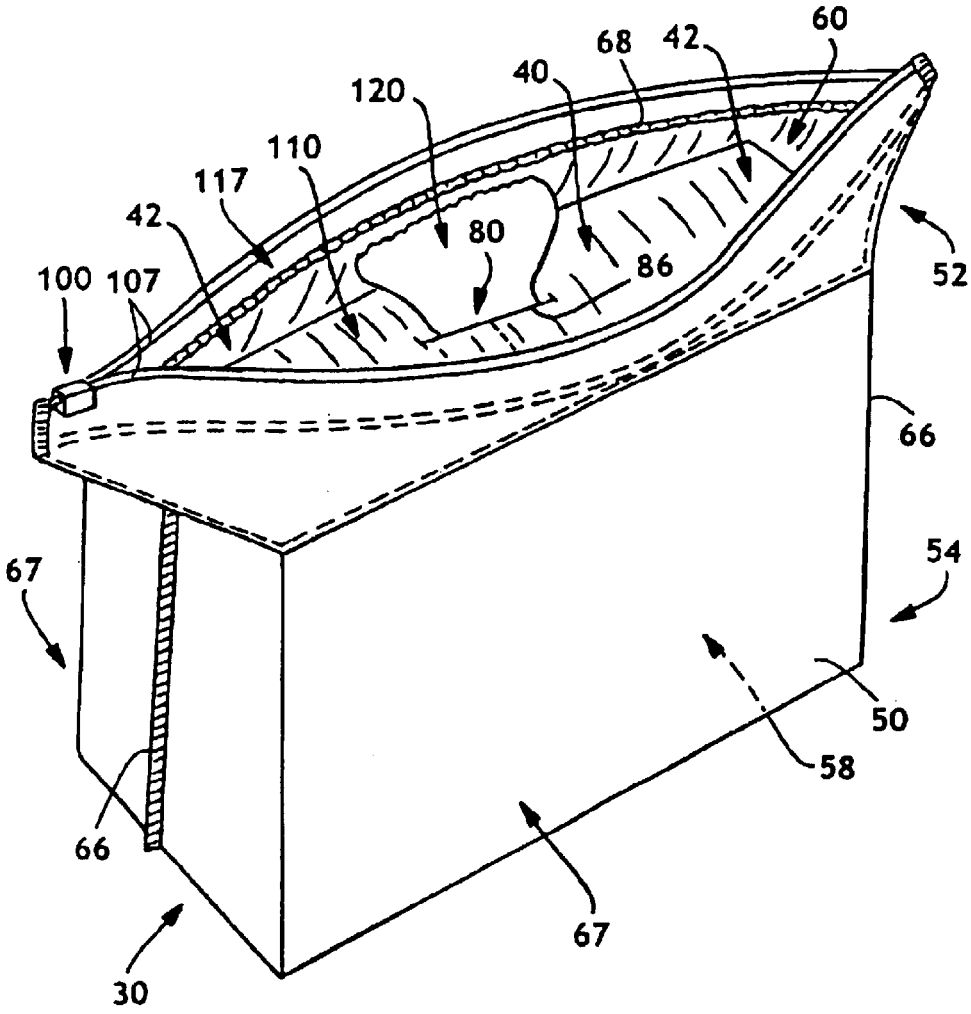
FIG. 1A representatively shows a perspective view of the package for wipes illustrated in FIG. 1 with a wipe partially dispensed and in an open position.

The present invention is directed at providing a new baffle structure for use in packages or containers for wipes, e.g., wet wipes. As representatively illustrated throughout the Figures, and for explanation now referring to FIGS. 1–2B, inclusive, the present invention provides a storing and dispensing package 20 for wipes 120. The package 20 includes a container 30 having sides 50 with a top end portion 52 and a bottom end portion 54, where the sides and top and bottom end portions define a cavity 56 within the container 30. The container may be rigid or non-rigid. As used herein, "non-rigid" means a non-foamed polymeric containing film with a thickness of about 250 micrometers or less or a foamed polymeric containing film with a thickness of about 2000 micrometers or less. An example of such a non-rigid package is seen in FIGS. 1, 1A and 2A, and further taught in WO 02/058524 mentioned previously. Examples of rigid packages are seen in U.S. Pat. No. 5,785,179 of Buczwinski et al. issued Jul. 28,1998 and U.S. Pat. No. 6,269,969 of Huang et al. issued Aug. 7, 2001, both owned by the same assignee as this application.

The cavity 56 includes a storage portion 58 for wipes 120. The top end portion 52 may include a resealable mechanism 100. A baffle structure 110 (e.g., which may be non-rigid) has a width 112, (e.g. FIGS. 13 and 15) and is located in between the resealable mechanism 100 and the storage portion 58 with the baffle structure 110 positioned between opposing sides 50 of the container spaced apart from each other. The baffle structure thereby defines a dispensing portion 60 of the cavity 56 overlying the storage portion 58 of the cavity. It is noted that "overlying" merely defines the positioning of various components of the package relative to one another when the package 20 is positioned in an upright position, e.g., as seen in FIG. 1. The invention also functions to dispense wipes when the package 20 is sideways or in the upside-down position (not shown). The baffle structure 110 includes a dispensing opening 80 through which wipes 120 may pass and communicate with the dispensing portion 60.

Figure 1B:
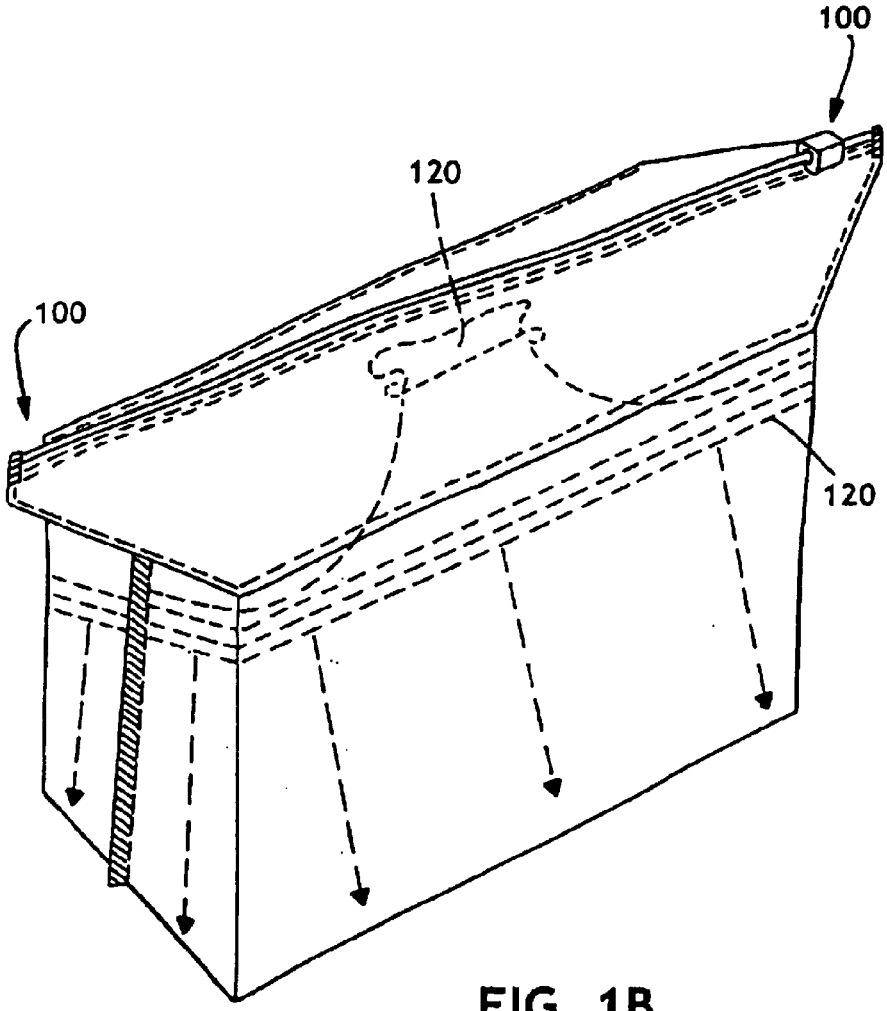
FIG. 1B representatively shows a perspective view of the package for wipes illustrated in FIG. 1A with the wipe partially dispensed and in the closed position.

As seen in FIGS. 1 and 1B, the resealable mechanism 100 is in a sealed closed position, whereas in FIG. 1A it is in an open position with wipes 120 inside the container. The mechanism 100 may be any type of mechanism that allows the package 20 to be opened, closed and reopened multiple times during the life of the package, e.g., a zipper with or without a slider, resealable adhesive, a clip or other structure that achieves the result desired here. Such a zipper may be a plastic zipper with a zipper track 107 (FIG. 1A) and attached flange which allows the track to be joined to the container 30. The zipper may include a slider 106 which slides along the track 107 to seal and unseal two sides of the track from each other. Such a plastic zipper mechanism is commercially available from Pactiv Corporation located at 1900 W. Field Court, Lake Forest, Ill. 60045 under the trademark Slide-Rite®.

The invention provides various new baffle structure characteristics, configurations and orientations, which may contribute to the operation and efficiency of the baffle structure (and resulting package for storing and dispensing wipes which employs the same). Such baffle structure 110 may be joined in container 30 as taught in WO 02/058524. Alternatively, structure 110 may be joined in other non-rigid or rigid (e.g., those mentioned previously) containers or packages as one of ordinary skill in the art would know to do in combination with the teachings herein. These characteristics, configurations and/or orientations may enhance the moisture retention of the package 20, especially when the resealable mechanism 100 is open (e.g., FIG. 1A). Additionally, the baffle structure 110 may enhance dispensing of the wipes 120, particularly for one-at-a-time dispensing in (i) a popup format where each wipe is held in the dispensing opening 80 (e.g., FIGS. 1A and 1B) while awaiting dispensing by a user or (ii) a reach-in format where each wipe is accessible through the dispensing opening 80 but is not retained in the dispensing opening while awaiting dispensing by a user.

Referring to FIGS. 2, 2A, 2B, 18 and 19, baffle structure 110 includes at least two layers. A "layer" is defined herein as any material that can be mechanically separated from an adjacent material so that the adjacent materials can move relative to one another during use as the baffle structure 110 (e.g. without limitation, materials that are co-extruded and separable from one another so an orifice may be formed in each layer as desired, or materials that are laminated together to define two or more layers). Baffle structure 110 may be formed, e.g., from two separate film layers joined to each other or a single film layer doubled back onto itself and joined appropriately. One such layer may be first layer 170 having a first length and a first width and a first dispensing orifice 172. Another such layer may be second layer 180 having a second length and a second width and a second dispensing orifice 182 (shown in phantom dotted line beneath orifice 172 in FIGS. 2, 18 and 19). The length of the layers is considered the longest dimension of the layer, respectively, and the width the shortest dimension, respectively, or the length and width, respectively, may be equal. In any event, the particular length and width are not important, and rather as long as each layer is considered to have an area for which the orifice 172 or 182, respectively, may be located is all that is necessary. It is the combination of the dispensing orifices that define the dispensing opening 80, i.e., the wipe needs to be able to pass through each of them individually and collectively and this path is generally opening 80. This path may be a relatively straight vertical path (e.g., FIGS. 1 to 2B, inclusive) or a more twisted vertical path (e.g., FIGS. 18 and 19).

The baffle structure 110 further includes first layer 170 at least partially contacting second layer 180 proximate the dispensing orifices 172 and 182, respectively. More particularly, depending on the non-rigidity of the layers and their location relative to one another, the first and second layers may be contacting each other across substantially their entire surfaces. Where the first layer is disposed over the second layer and at least partially contacts the second layer proximate the dispensing orifices, the first layer is distinct from the second layer so as to be movable relative to the second layer. In this way, the baffle structure utilizes the synergy gained by a multiple layer baffle structure to better control dispensing forces imparted to the wipes during dispensing. For example, while the first layer will be disposed over the second layer, the dispensing orifices may be disposed relative to each other in the range from not overlying each other (e.g., FIGS. 18 and 19) to at least partially overlying each other (e.g., FIGS. 1 to 2B, inclusive) to completely overlying each other (i.e., not specifically shown but where one orifice is a subset of the other, e.g., a slit overlying a hole or vice versa where the slit length is less than the hole's diameter).

Figure 2:
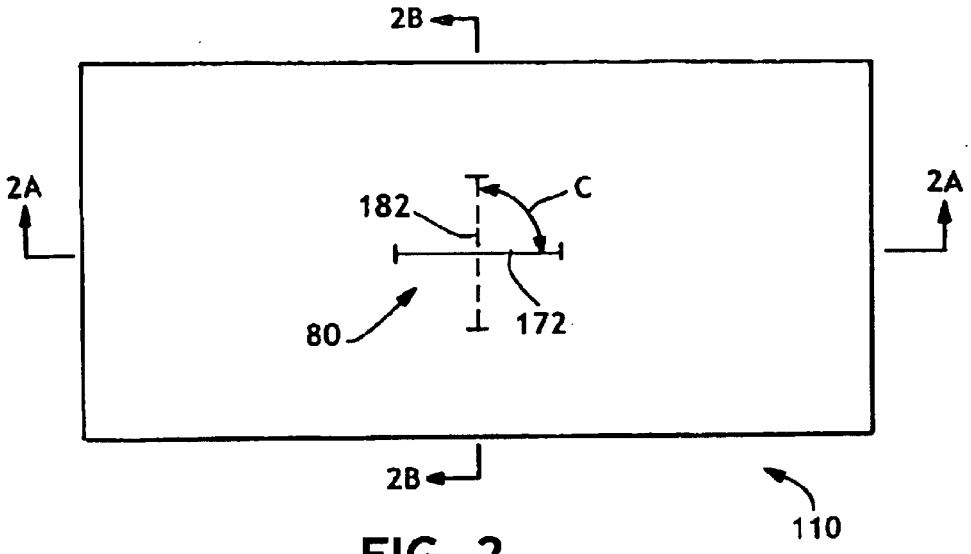
FIG. 2 representatively shows a top plan view of a configuration of a baffle structure with at least two dispensing orifices, for use in the present invention.
Figure 2A:
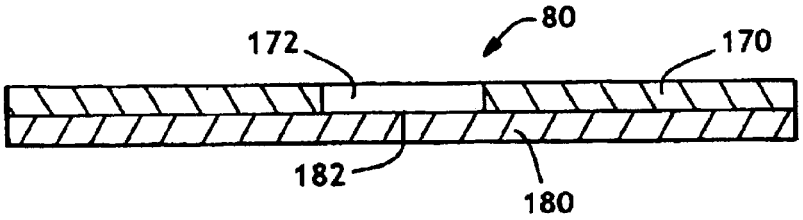
FIG. 2A representatively shows a cross-sectional view of the baffle structure seen in FIG. 2, taken along the line 2A—2A.
Figure 2B:
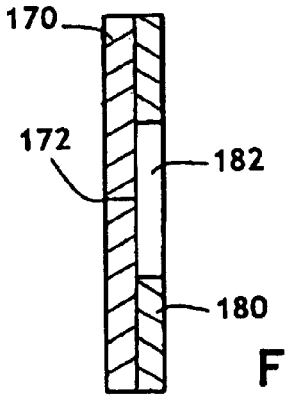
FIG. 2B representatively shows a cross-sectional view of the baffle structure seen in FIG. 2, taken along the line 2B—2B.

As seen in FIGS. 1 to 2B, inclusive, the first dispensing orifice 172 may be disposed at least partially overlying the second dispensing orifice 182. For example, when viewed from above looking down as in FIG. 2, at least a portion of each dispensing orifice intersects with the other. Each dispensing orifice includes the position when the sides of the orifice may be touching (e.g., FIGS. 2, and 6–8) to the position where the sides are spread apart as far as they go due to being formed that way (e.g., FIGS. 9–12) or due to natural folding over of edges of the orifice during dispensing, and all positions in between these. First dispensing orifice 172 has a first longitudinal axis oriented in a first direction and second dispensing orifice 182 has a second longitudinal axis oriented in a second direction. For example, as seen in FIG. 2, orifice 172 has its longitudinal axis oriented along line 2A—2A and orifice 182 has its longitudinal axis oriented along line 2B—2B. More generally, the longitudinal axis of each orifice will be defined along the longest dimension of the smallest four sided box (and that box having four right angles) that encloses the orifice when in its maximum open position, such open position discussed just above. The first direction may be non-parallel relative to the second direction. For example, as seen in FIG. 2, the first and second directions may be perpendicular to one another (i.e., when angle C is 90 degrees). Alternatively, angle C between the first and second directions may be anywhere from 0 degrees to 180 degrees.

In other aspects, the baffle structure may have the first longitudinal axis with a first midpoint and the second longitudinal axis with a second midpoint, and the first midpoint may be aligned with the second midpoint relative to a vertical axis. Alternatively, only one of the first or second axis may have its midpoint aligned with the axis of the other orifice. For example, as seen in FIG. 2, the midpoints of orifices 172 and 182, respectively, are their point of intersection and both orifices are aligned with each other. In another aspect, the first dispensing orifice and the second dispensing orifice may be substantially the same size and shape (e.g., as seen in FIG. 2).

Without being limited to a theory of operation, it is believed that the various features of the multiple layer baffle structure disclosed here may contribute alone, and in combination, to varying the dispensing resistance desired for the opening 80 (i.e., which is dependent upon the wipes being dispensed therethrough (e.g., due to: the composition of the wipe material, the solution moistening the wipe (if any), handling of the wipe during manufacturing, the type of separably joined relationship between adjacent wipes, the folded or unfolded configuration of the wipes, the relationship of one wipe to any adjacent wipes, and the like)). Summarizing, without limitation, such may be provided by varying the angle C between the first and second direction of orifices 172 and 182, respectively, by varying the shape and/or size of the orifices, by varying the overlapping of the orifices, by varying the relative size of the orifices such that one is larger than the other, by varying the material of the at least two layers (e.g., their composition, processing, thickness, rigidity), and combinations of these.

Figure 13:
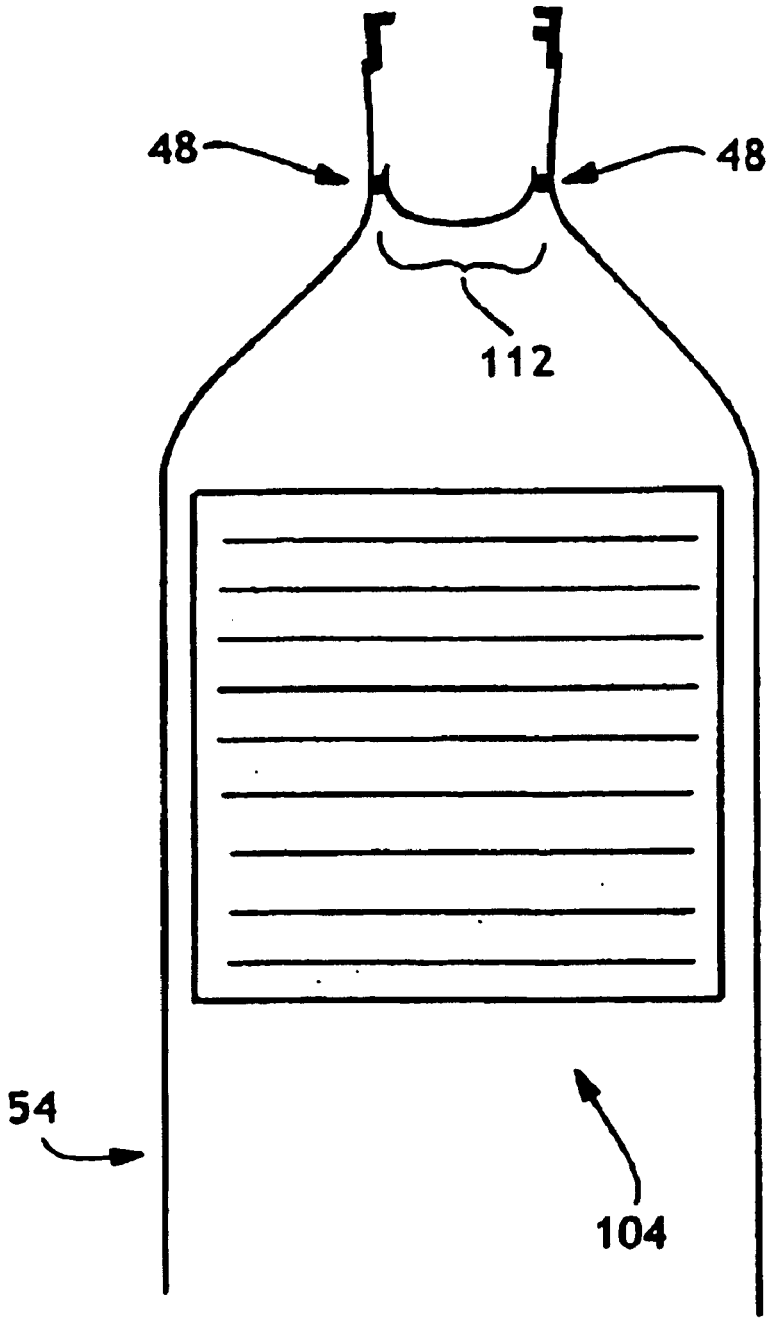
FIG. 13 representatively shows a cross-sectional view of another example of a package for wipes according to the present invention before dispensing any wipes and in an open position, with wipes positioned inside the partially assembled package.
Figure 15:
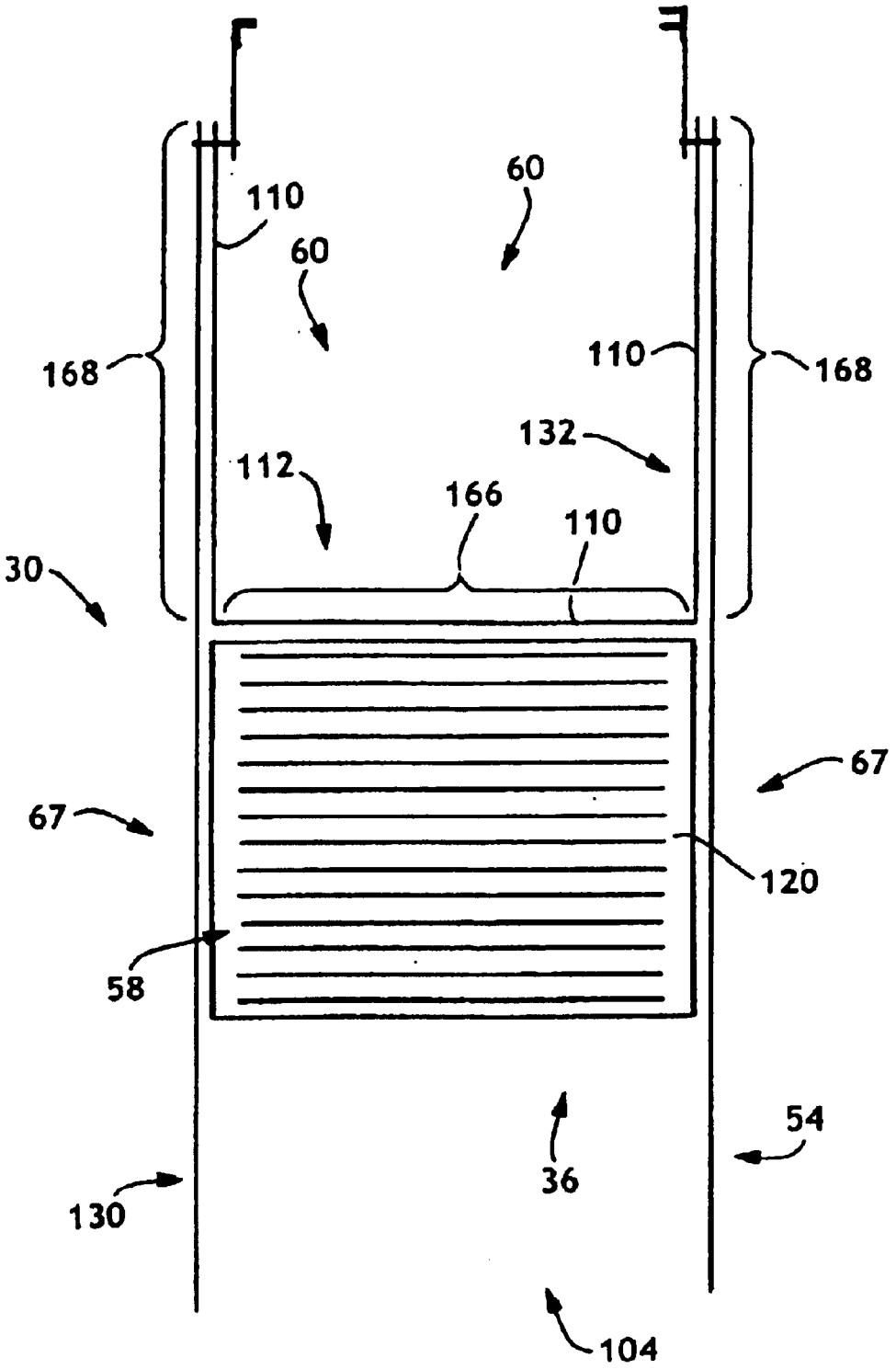
FIG. 15 representatively shows a cross-sectional view of another example of a package for wipes according to the present invention before dispensing any wipes and in an open position, with wipes positioned inside the partially assembled package.
Figure 17:
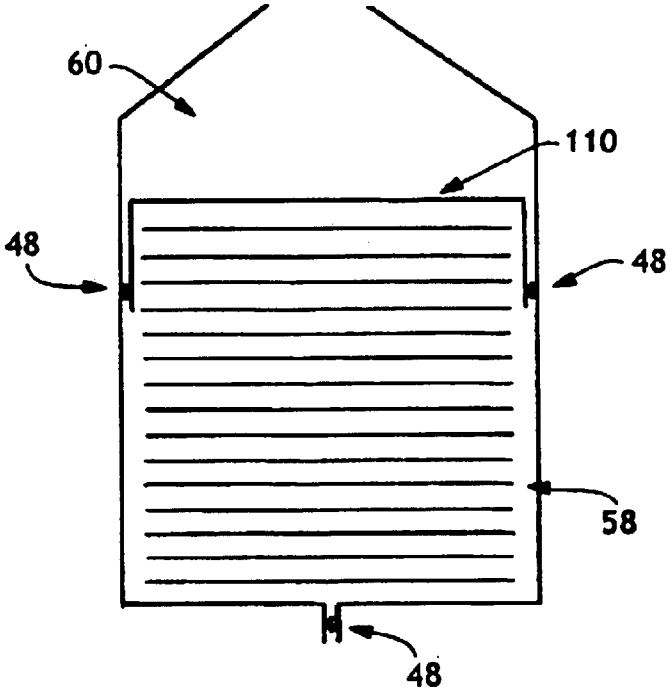
FIG. 17 representatively shows the package seen in FIG. 16, with wipes positioned inside the fully assembled package and before dispensing any wipes and in an open position.
Figure 16:
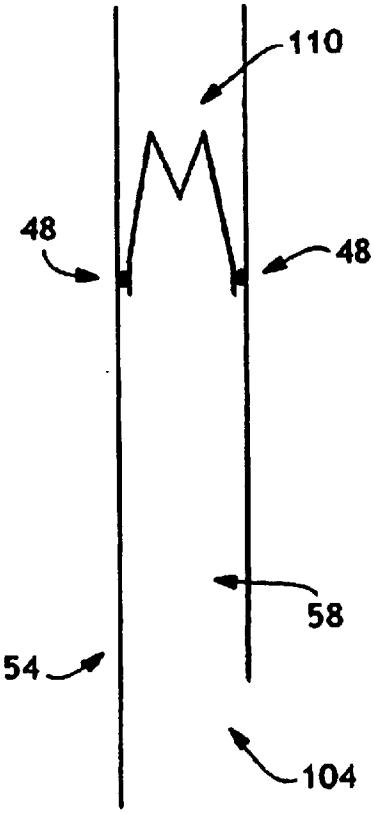
FIG. 16 representatively shows a cross-sectional view of another example of a package for wipes according to the present invention, without wipes positioned inside the storage portion of the partially assembled package.
Figure 18:
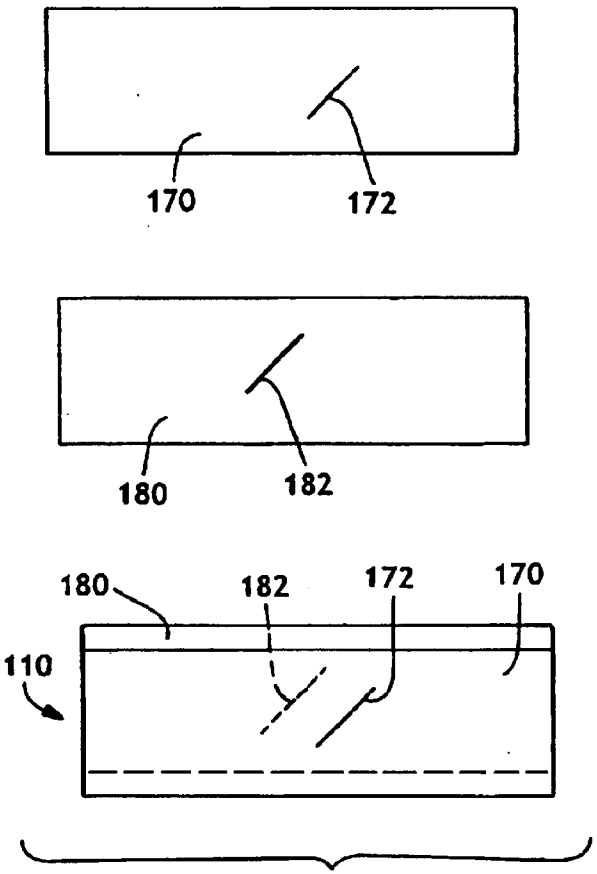
FIGS. 18 and 19 representatively show a top plan view of additional examples of orientations of dispensing orifices for use in the present invention.
Figure 19:
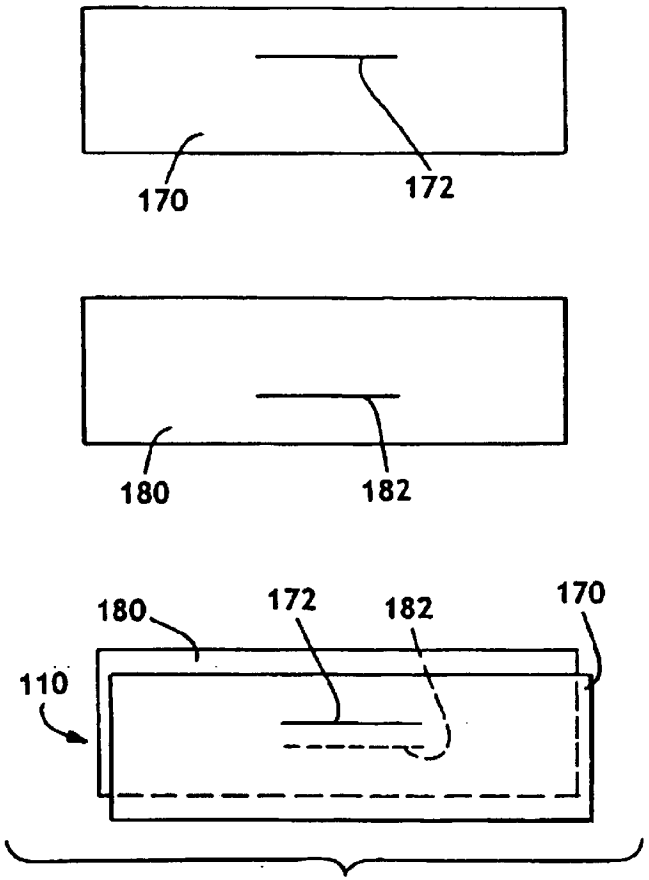

The baffle structure 110, and consequently its one or more layers, may be non-rigid and/or have a collapsible-expandable characteristic. This characteristic defines the ability of the baffle structure as a whole to expand and collapse between the sides 50 of the container 30. This may be due, e.g., to the flexible nature of the sides 50 in combination with the non-rigidity of the baffle structure, to the size of the baffle structure relative to the distance between opposing sides 66, to a combination of these, or to any other mechanism by which the baffle structure as a whole (i.e., in contrast to merely the dispensing opening 80 in the baffle structure) may expand and collapse between the sides 50 of the container 30. For example, referring to FIG. 13, a width 112 of the baffle structure may be less than a width 36 (FIG. 1) of the container as long as it has at least some width to allow some separation between opposing sides 67 of the container when the resealable mechanism is in the open position. Alternatively, referring to FIG. 15, the width of the baffle structure may be greater than the width 36 of the container. Here, the width 112 of the baffle structure includes not only dimension 166, but also dimension 168 twice. Further, the width 112 may advantageously be at least as great as the width of the container, more advantageously be at least about 1.5 times as great as the width of the container, and most advantageously be at least about 2 times as great as the width of the container and not more than about 3 times as great as the width of the container. In FIGS. 13,15 and 16, the bottom end portion 54 is in an open position 104, whereas in the other Figures it is sealed closed (e.g., FIGS. 1, 15 and 17).

Figure 14:
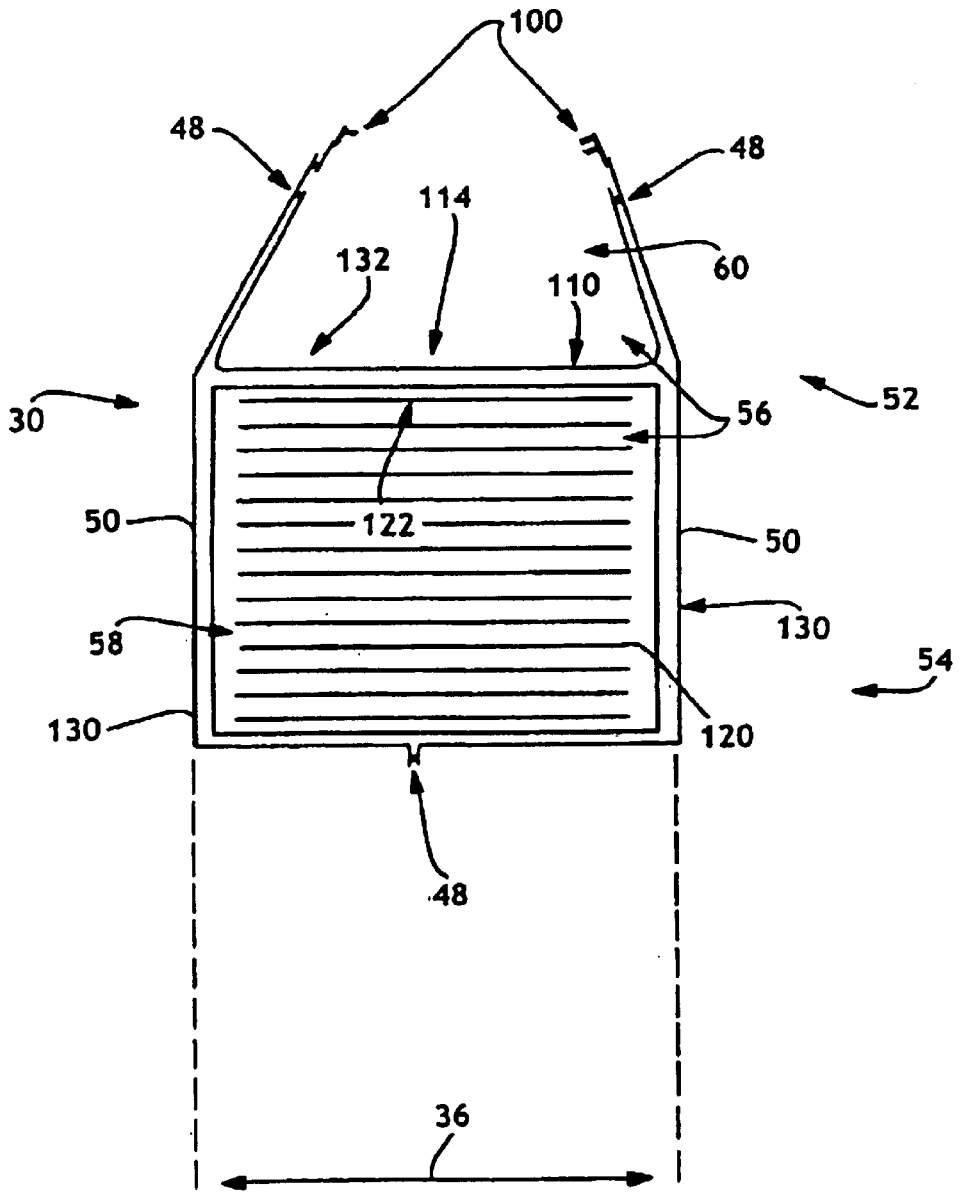
FIG. 14 representatively shows a cross-sectional view of another example of a package for wipes according to the present invention before dispensing any wipes and in an open position, with wipes positioned inside the fully assembled package.

Referring to, e.g., FIGS. 1 to 1B and 14, a configuration and orientation for baffle structure 110 is where a center area portion 114 of the baffle structure is oriented substantially parallel to an adjacent surface area 122 of the wipes 120 which are positioned within the storage portion 58 of the cavity. For example, such provides close access to the underlying wipes should a partially dispensed wipe inadvertently fall back into storage portion 58. Also, e.g., such assists in maintaining a partially dispensed wipe in that position while awaiting next dispensing. For similar reasons, another configuration and orientation for baffle structure 110 is where the center area portion 114 of the baffle structure rests on an adjacent surface area 122 of the wipes which are positioned within the storage portion 58 of the cavity. The package 20 of the present invention may be formed from various configurations. Also referring to FIGS. 15–17, for example, the container 30 may be a first piece of material 130 and the baffle structure 110 may be formed from a second piece of material 132 separate from the first piece of material. Here, "separate" means that at some time prior to formation of the package 20 the first piece of material 130 is not joined to the second piece of material 132. Then, after formation the two pieces 130 and 132 are joined together, such as seen in FIGS. 14–17. Alternatively, the container 30 and the baffle structure 110 may be formed from one continuous piece of material 134 (not shown, but as taught in WO 02/058524 in reference to FIGS. 19, 20 and 25 there).

Figure 5:
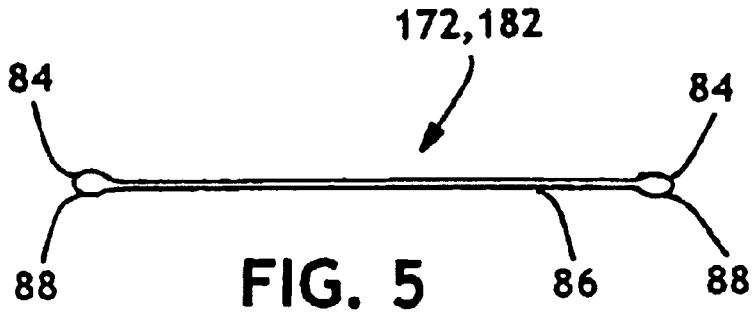
FIGS. 5–8 representatively show a top plan view of additional examples of configurations of dispensing orifices for use in the present invention.
Figure 6:
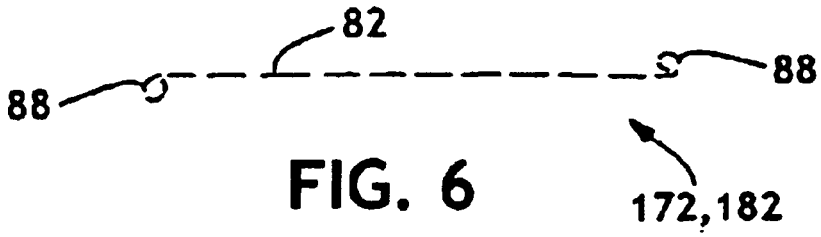
Figure 7:
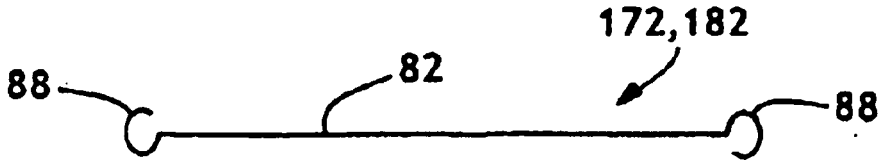
Figure 8:
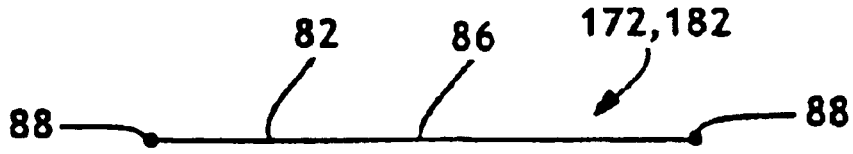
Figure 9:
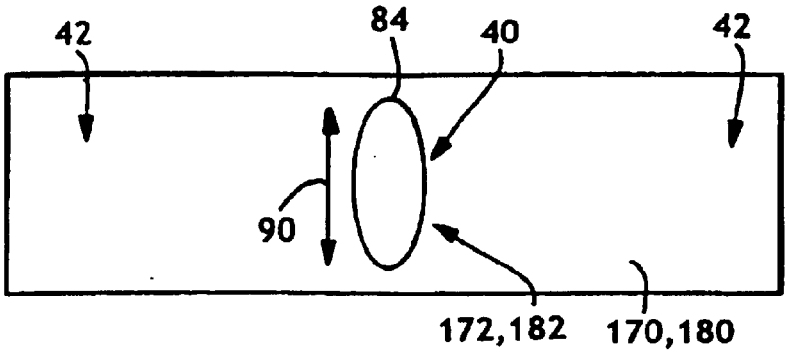
FIGS. 9–12 representatively show a top plan view of additional examples of orientations of dispensing orifices for use in the present invention.

Referring to representative FIGS. 5–12, the invention provides the dispensing orifices, having various possible characteristics. These figures show a single layer for illustration purposes, where it is understood that two or more layers with these, or related, characteristics and/or configurations may be joined to form baffle structure 110. The dispensing orifices may be a frangible seal 82, such as formed by a perforated pattern with intermittent broken segments or merely weakened segments (FIG. 6). Alternatively, frangible seal 82 may be merely a weakened line of material (FIG. 7) which does not allow a fluid to pass therethrough until first broken. For example, seal 82 may, upon manufacture, be sealed closed (i.e., partially or completely as just discussed) and then opened for the first time by a user. In this way the frangible seal may serve as a tamper proof seal where a broken seal will evidence possible compromise of the integrity of the wipes inside. Alternatively, the orifices may be a slit 86 with a slight opening along its length (FIG. 5) or with no apparent opening along its length (FIG. 8) due to merely cutting the layer(s) without removing any material or pre-forming a slit as in FIG. 5. When either orifice is a slit, it may be of any length desirable for dispensing wipes. It may have die-cut circles acting as anti-tear end portions 88 (FIG. 5). When either orifice is a slit, it may also include an anti-tear end portion 88, so that during use the orifice it better maintains its original size and shape. Yet alternatively, either dispensing orifice may be a hole 84 (FIGS. 9 to 12), a combination of a slit and a hole (FIG. 5) or a combination of any of these. Advantageously, though not so limited, the baffle may be made from a non-oriented polymeric film to further inhibit tearing during use.

Figure 10:
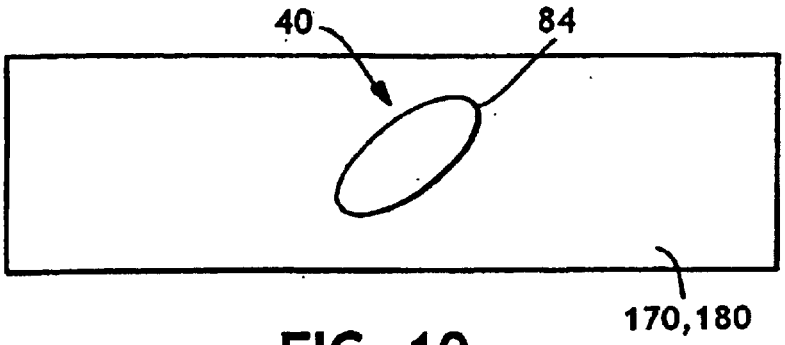
Figure 11:
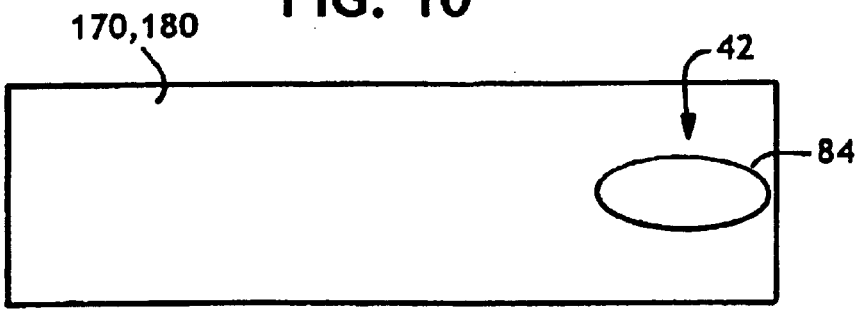
Figure 12:
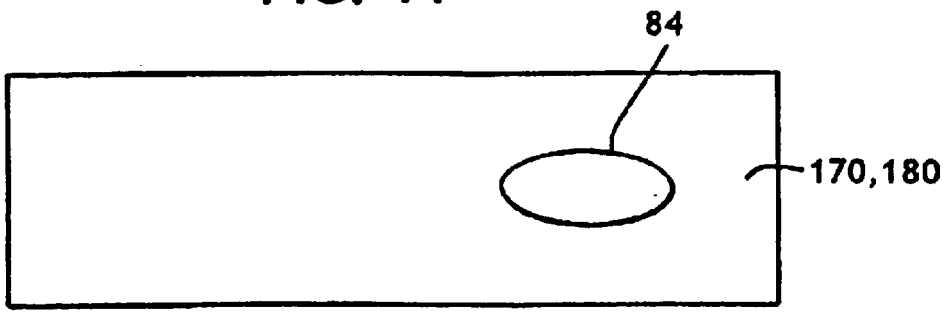

At least one dispensing orifice 172 or 182, respectively, may be oriented so a longitudinal dimension 90 (FIG. 9) of the orifice is positioned approximately parallel with a length 124 of the wipes 120 (FIGS. 1 and 12), approximately perpendicular with the length of the wipes (FIG. 9) or approximately diagonally with the length of the wipes (FIG. 10). Additionally, the orifices may be located relative to the longitudinal axis 32 (FIG. 1) of the container 30 at a position including a center portion 40 of the container (FIGS. 1, 9 and 10), an end portion 42 of the container (FIGS. 1 and 11) and between an end portion 42 of the container and a center portion 40 of the container (FIG. 12). Such orifice characteristics assist a user in dispensing wipes, e.g., holding a wipe in a partially dispensed position awaiting later dispensing, reducing exposure of a majority of the non-dispensed wipes to an outer environment even when the resealable mechanism is open, and the like.

Referring to WO 02/058524 mentioned previously, e.g., as well as FIGS. 1 to 1B, inclusive, seen herewith, package 20 may be made from various materials and in various configurations. The baffle structure 110 may be made of polyester film laminated to polyethylene film. The polyester film may be reverse printed, so the printing is between the two film layers. The film layers may be composed of one or more layers of polyolefin, and, e.g., formed in a coextrusion. The baffle structure 110 may be any size sufficient to span the container opening, as desired, to aid in the storing and dispensing of wipes. As seen in FIG. 1A, baffle structure 110 may be joined into the sides 66 of the container sides 50 and/or joined at its top portion 117 to opposing container sides 67 along some or all of zone 68 (e.g., see also FIGS.

5 to 8 in WO 02/058524). In these ways the baffle structure 110 spans between opposing sides 66 and/or 67 of the container 30. Alternatively, baffle structure 110 may be free at its opposite ends and joined with the container 30 merely where opposing sides 67 join the baffle structure's top portions 117 along some or all of zone 68. In this way, a space exists between baffle ends and adjacent container sides 66. Thus, dispensing portion 60 may communicate with storage portion 58 through the spaces (and also through the dispensing opening 80 if it is hole 84 or slit 86 without frangible seal or with a broken frangible seal). Yet alternatively, baffle structure 110 may be free at its top portions 117 and joined with the container 30 merely at baffle opposite ends to respective container sides 66 (not shown but as would be readily understood based on the above discussion). Still alternatively, the baffle structure 110 may be joined to the container 30 for little or no movement relative to the container in a longitudinal direction 32 (FIG. 1) of the container 30.

If all opposite top portions 117 or ends of the baffle structure are joined to respective opposing sides 67 and 66 of the container, then the baffle structure may span between the opposing sides of the container and completely separate the storage portion 58 of the cavity from the dispensing portion 60 except at the dispensing opening 80 (FIGS. 1A and 1B)(i.e., when the dispensing opening 80 is a hole 84 or slit 86 without frangible seal or with a broken frangible seal). Additionally, if the package 20 also has a dispensing orifice with slit 82 having a frangible seal unbroken, then the baffle structure 110 may span between the opposing sides of the container and completely separate the storage portion of the cavity from the dispensing portion of the cavity, even at the dispensing orifice (FIG. 1).

The "joining" of various package components, e.g., baffle structure 110, layers 172 and 182, respectively, container 30, sides 50, resealable mechanism 100, may be by various mechanical and chemical methods known in the art, including, but not limited to, use of glue or other bonding material, thermal bonding or welding, ultrasonic bonding or welding, or other joining methods as long as they create a permanent joined relationship between components as opposed to a resealable relationship therebetween. As seen throughout the Figures, a first piece or portion of package material is representatively joined by any of the just-mentioned methods to a second piece or portion of package material at a material attachment location 48. An attachment location generally represents a linear attachment zone, though it could be any method adequate to form a seal between two opposing layers of material to separate an environment on one side of the material from an environment on a different side of the material.

Figure 3:
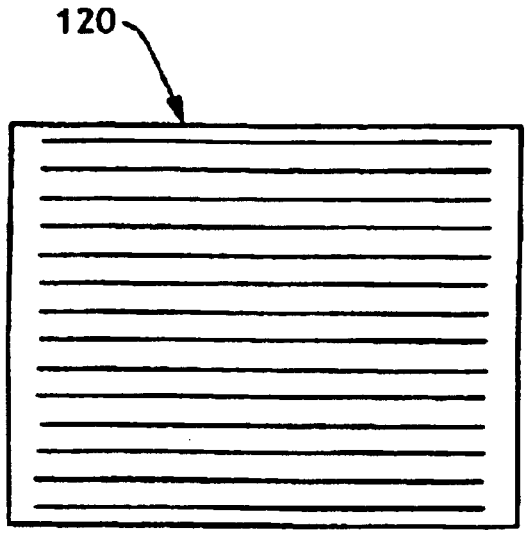
FIG. 3 representatively shows a cross-sectional view of a stack of wipes for use in the present invention.

Once the container is formed with wipes therein as seen in FIGS. 1 to 1B, inclusive, then package 30 is now completely formed and ready for use by a user (not shown). The assembled and filled package may be like that seen in FIGS. 16 and 17, or any of a variety of other configurations as taught herein or in WO 02/058524 mentioned previously. In use, the resealable mechanism 100 is opened and then access to the dispensing portion 60 is gained. The user then passes his or her hand, etc. through the opening 80 to grab the first wipe in the stack of wipes 120. If either dispensing orifice 172 or 182 is a frangible seal 82, this must be broken before the user may pass his or her hand through that orifice. Once the user grabs the wipe, it may then pass through each orifice 172 and 182 and enter the dispensing portion 60 as the user pulls it up. If the user does not immediately need the wipe, it may be left in the opening 80 partially dispensed where it may be maintained in place by the baffle structure 110 until desired later. The resealable mechanism may be sealed closed if no further wipes are desired in order to best maintain the hygiene and/or moisture level of the wipes. The partially dispensed wipe will just rest in place in the orifice, part in the dispensing portion and part in the storage portion, conveniently ready for later dispensing. If the user does immediately desire to use the wipe, it may pass the complete wipe through the dispensing portion and out of the package. Depending on the configuration of the stack (FIG. 3) or roll (FIG. 4) of wipes 120, the next wipe for dispensing may be automatically maintained in the opening partially dispensed for later use (i.e., a popup dispensing format) or it may need to be fetched out of the storage portion similar to the first wipe at a later time when it is desired. In either case, after the desired number of wipes are taken, the resealable mechanism may be sealed closed, with or without a wipe partially dispensed in the dispensing portion, as discussed previously.

The wipes, e.g., wet wipes, may be arranged in the package 20 in any manner which provides convenient and reliable one at a time dispensing and which assists the wet wipes in not becoming overly dry. For example, the wet wipes may be arranged in the package 20 as a plurality of individual sheets arranged in a stacked configuration (FIG. 3) to provide a stack of wet wipes which may or may not be individually folded. The wet wipes may be individual wet wipes which are folded in a c-fold, z-fold or other zigzag configuration as are known to those skilled in the art and then stacked on top of each other to provide the stack of wet wipes. Alternatively, if the wet wipes are to be arranged in a stacked configuration in the package 20, the individual wet wipes may be interfolded such that the leading and trailing end edges of successive wipes in the stacked configuration overlap. In such a configuration, the leading end edge of the trailing wet wipe is loosened from the stack by the trailing end edge of the leading wet wipe as the leading wet wipe is removed by the user. The wet wipes may be interfolded to facilitate such dispensing by means known to those skilled in the art. One example of such well known interfolded means is set forth in U.S. Pat. No. 5,497,903, issued Mar. 12, 1996, of inventor Katsu Yoneyama, the disclosure of which is incorporated fully herein by reference.

Figure 4:
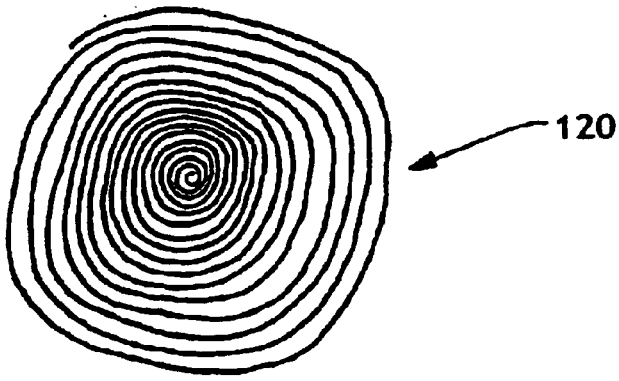
FIG. 4 representatively shows a cross-sectional view of a roll of wipes for use in the present invention.

Alternatively, the wet wipes may be arranged in the package 20 as a continuous web of interconnected wet wipes which are folded in an accordion-like stacked configuration or a roll (FIG. 4). The individual wet wipes may be connected together along lines of frangibility, such as lines of perforations, to ensure that the trailing wet wipe is in position for grasping by the user after the leading wet wipe is removed. For example, the wet wipes may be provided by a continuous web of material which has a series of lines of frangibility extending across the width of the web. The portion of the web of material between successive lines of frangibility provides each individual wet wipe. The lines of frangibility may be provided by means known to those skilled in the art such as perforations, indentations or cuts in the web of material. For example, the lines of frangibility or perforations may be provided in the web of material by passing the web of material between a die cutter roll and anvil roll. After the lines of frangibility have been incorporated into the web of material, the web may then be arranged in a stacked configuration for easy insertion into the storage portion 58 of the package 20. An example of a continuous zigzag configured stack is seen in U.S. Ser. No. 09/871,019, entitled "STACK OF FAN FOLDED MATERIAL AND COMBINATIONS THEREOF" of Gerald Sosalla filed May 31, 2001 and assigned to the same assignee as this application.

The package 20 of the present invention may include any suitable number of individual wet wipes depending upon the desired packaging and end use. For example, the package 20 may be configured to include a stack of wet wipes which may include at least about 5 wet wipes and desirably from about 16 to about 320 individual wet wipes, and more desirably from about 32 to about 160 wet wipes. The size and shape of the stack of wipes 120 is dependent upon the size and shape of the package 20 and vice versa. For example, the length 124 (FIG. 1) of the assembled stack of wipes may be about 190 mm, with a height of about 90 mm and a width of about 110 mm.

Each wet wipe is generally rectangular in shape and defines a pair of opposite side edges and a pair of opposite end edges which may be referred to as a leading end edge and a trailing end edge. The leading end edge of each wet wipe is typically positioned in the package 20 to be grasped by a user to facilitate a removal of the wet wipe from the package 20. Each wet wipe defines an unfolded width and an unfolded length. The wet wipe may have any suitable unfolded width and length. For example, the wet wipe may have an unfolded length of from about 2.0 to about 80.0 centimeters and desirably from about 10.0 to about 26.0 centimeters and an unfolded width of from about 2.0 to about 80.0 centimeters and desirably from about 10.0 to about 45.0 centimeters.

Materials suitable for the wet wipes of the present invention are well known to those skilled in the art. The wet wipes may be made from any material suitable for use as a moist wipe, including meltblown, coform, air-laid, bonded-carded web materials, hydroentangled materials, high wet-strength tissue and the like and may comprise synthetic or natural fibers or combinations thereof. The wet wipes may have a basis weight of from about 25 to about 120 grams per square meter and desirably from about 40 to about 90 grams per square meter.

In a particular aspect, the wet wipes may comprise a coform basesheet of polymeric microfibers and cellulosic fibers having a basis weight of from about 60 to about 100 grams per square meter and desirably about 80–85 grams per square meter. Such coform basesheets are manufactured generally as described in U.S. Pat. No. 4,100,324 to Anderson et al. which issued Jul. 11, 1978, and which is herein incorporated by reference. More particularly, such coform basesheets may be manufactured as described in the filed patent application entitled, "COMPOSITE MATERIAL WITH CLOTH-LIKE FEEL" of inventors Scott R. Lange et al. filed on Dec. 29, 2000 also known as WO 02/053365 published Jul. 11, 2002, which is incorporated herein by reference, or as described in 09/871,019 mentioned previously.

The wipes of the different aspects of the present invention may contain a liquid which may be any solution which may be absorbed into the wipes, thus making them "wet wipes." The liquid contained within the wet wipes may include any suitable components which provide the desired wiping properties. For example, the components may include water, emollients, surfactants, preservatives, chelating agents, pH buffers, fragrances or combinations thereof. The liquid may also contain lotions, ointments and/or medicaments.

The amount of liquid contained within each wet wipe may vary depending upon the type of material being used to provide the wet wipe, the type of liquid being used, the type of container being used to store the stack of wet wipes, and the desired end use of the wet wipe. Generally, each wet wipe may contain from about 150 to about 600 weight percent and desirably from about 200 to about 400 weight percent liquid based on the dry weight of the wipe for improved wiping. In a particular aspect wherein the wet wipe is made from a coform material comprising from about 30 to about 40 weight percent polymeric microfibers based on the dry weight of the wipe, the amount of liquid contained within the wet wipe is from about 250 to about 350 weight percent and desirably about 330 weight percent based on the dry weight of the wet wipe. If the amount of liquid is less than the above-identified range, the wet wipes may be too dry and may not adequately perform. If the amount of liquid is greater than the above-identified range, the wet wipes may be over saturated and soggy and the liquid may pool in the bottom of the container.

One or the other of the container 30 and the baffle structure 110 of the packages 20 of the invention may be transparent, translucent or opaque. There are certain features associated with either of the container or the baffle structure being transparent or translucent. For example, when the container 30 is transparent, the user of the package 20 may readily determine the quantity of wet wipes remaining in the package. That is, the user may determine the quantity of wet wipes remaining in the package 20 without having to open the resealable mechanism 100 of the package.

Aesthetic and functional features are also obtained when one or the other of the container 30 or baffle structure 110 are colored. For example, differently colored containers may be used to distinguish the packaging for different types of wet wipe products. Similarly, aesthetic and functional features may be achieved when the container 30 or the baffle structure 110 have graphics printed on them. In addition to aesthetic benefits, the graphics may be used to distinguish between various wet wipe product types.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that the spirit and scope of the present invention should be assessed accordingly to that of the appended claims.

What is claimed is:

1. A baffle structure for dispensing a wipe therethrough comprising:

at least a first layer comprising a non-rigid film, the first layer having a first length and a first width and a first dispensing orifice; and at least a second layer comprising a non-rigid film, the second layer having a second length and a second width and a second dispensing orifice, wherein the first layer is disposed over the second layer and at least partially contacts the second layer proximate the dispensing orifices and the first layer is distinct from the second layer so as to be movable relative to the second layer and the wipe may be dispensed sequentially through the first dispensing orifice and the second dispensing orifice.

2. The baffle structure of claim 1 wherein the first dispensing orifice is disposed over the second dispensing orifice and at least partially intersecting the second dispensing orifice relative to a vertical plane extending through the first and second orifices.

3. The baffle structure of claim 1 wherein the first dispensing orifice has a first longitudinal axis oriented in a first direction and the second dispensing orifice has a second longitudinal axis oriented in a second direction and wherein the first direction is non-parallel relative to the second direction.

4. The baffle structure of claim 3 wherein the first direction is about perpendicular relative to the second direction.

5. The baffle structure of claim 3 wherein the first longitudinal axis has a first midpoint and the second longitudinal axis has a second midpoint and wherein the first midpoint is aligned with the second midpoint relative to a vertical axis.

6. The baffle structure of claim 1 wherein the first dispensing orifice and the second dispensing orifice are substantially the same size and shape.

7. The baffle structure of claim 1 wherein at least one dispensing orifice comprises a frangible seal.

8. The baffle structure of claim 5 wherein the frangible seal is closed until opened for a first time by a user of the baffle structure.

9. The package of claim 1 wherein at least one dispensing orifice comprises a member from the group comprising a hole, a slit and a combination of a hole and a slit.

10. The package of claim 1 wherein at least one dispensing orifice comprises anti-tear end portions disposed adjacent the orifice.

11. A storage and dispensing package for wipes comprising:

a container having sides which define a cavity therein;

a baffle structure having a width and positioned within the sides of the container and dividing the cavity into a storage portion for wipes and a dispensing portion; and the baffle structure comprising:

at least a first layer having a first length and a first width and a first dispensing orifice;

at least a second layer having a second length and a second width and a second dispensing orifice, wherein the first layer at least partially contacts the second layer proximate the dispensing orifices and the first dispensing orifice is disposed at least partially overlying the second dispensing orifice; and wherein the first dispensing orifice has a first longitudinal axis oriented in a first direction and the second dispensing orifice has a second longitudinal axis oriented in a second direction and wherein the first direction is non-parallel relative to the second direction, and the wipe may be dispensed therethrough and communicate with the dispensing portion.

12. The package of claim 11 further comprising a resealable mechanism, the resealable mechanism adjoining at least two sides of the container.

13. The package of claim 11 wherein at least two opposite sides of the baffle structure are joined to respective opposing sides of the container spaced apart from each other and thereby the baffle structure spans between the opposing sides of the container.

14. The package at claim 13 wherein all opposite sides of the baffle structure are joined to respective opposing sides of the container and thereby the baffle structure spans between the opposing sides of the container and completely separates the storage portion of the cavity from the dispensing portion of the cavity except at the dispensing orifice.

15. The package of claim 13 wherein all opposite sides of the baffle structure are joined to respective opposing sides of the container and thereby the baffle structure spans between the opposing sides of the container and completely separates the storage portion of the cavity from the dispensing portion of the cavity.

16. The package of claim 12 wherein wipes are positioned within the storage portion of the cavity.

17. The package of claim 16 wherein a center area portion of the baffle structure is oriented substantially parallel to an adjacent surface area of the wipes which are positioned within the storage portion of the cavity.

18. The package of claim 11 wherein the baffle structure is joined to the container for little or no movement relative to the container in a longitudinal direction of the container.

19. The package of claim 16 wherein the baffle structure is configured such that a center area portion of the baffle structure rests on an adjacent surface area of the wipes which are positioned within the storage portion of the cavity.

20. The package of claim 11 wherein the width of the baffle structure is at least as great as a width of the container.

21. The package of claim 16 wherein the wipes comprise wet wipes.

22. The package of claim 11 wherein each dispensing orifice comprises a member from the group comprising a hole, a slit and a combination of a hole and a slit.

23. The package of claim 11 wherein at least one dispensing orifice comprises anti-tear end portions disposed adjacent the orifice.

24. The package of claim 11 wherein at least one dispensing orifice is oriented so a longitudinal dimension of the orifice is positioned comprising a member from the group comprising approximately parallel with a length of the wipes, approximately perpendicular with a length of the wipes and approximately diagonally with a length of the wipes.

25. The package of claim 11 wherein at least one dispensing orifice is located relative to a longitudinal axis of the container at a position comprising a member from the group comprising a center portion of the container, an end portion of the container and between an end portion of the container and a center portion of the container.

26. The package of claim 12 wherein the resealable mechanism comprises a resealable track and a slider for sealing and unsealing the track.

27. The package of claim 11 wherein the container is non-rigid.

28. A baffle structure for dispensing a wipe therethrough comprising:

at least a first layer comprising a non-rigid film, the first layer having a first length and a first width and a first dispensing orifice;

at least a second layer comprising a non-rigid film, the second layer having a second length and a second width and a second dispensing orifice, wherein the first layer at least partially contacts the second layer proximate the dispensing orifices and the first dispensing orifice is disposed at least partially overlying the second dispensing orifice; and wherein the first dispensing orifice has a first longitudinal axis oriented in a first direction and the second dispensing orifice has a second longitudinal axis oriented in a second direction and wherein the first direction is non-parallel relative to the second direction, and the wipe may be dispensed therethrough.

29. The baffle structure of claim 28 wherein the first direction is about perpendicular relative to the second direction.

30. The baffle structure of claim 28 wherein the first longitudinal axis has a first midpoint and the second longitudinal axis has a second midpoint and wherein the first midpoint is aligned with the second midpoint relative to a vertical axis.

31. A baffle structure for dispensing a wipe therethrough comprising:

at least a first layer having a first length and a first width and a first dispensing orifice comprising a slit;

at least a second layer having a second length and a second width and a second dispensing orifice comprising a slit, wherein the first layer at least partially contacts the second layer proximate the dispensing orifices and the first dispensing orifice is disposed at least partially overlying the second dispensing orifice.

32. The baffle structure of claim 31 wherein the first dispensing orifice has a first longitudinal axis oriented in a first direction and the second dispensing orifice has a second longitudinal axis oriented in a second direction and wherein the first direction is non-parallel relative to the second direction.

33. The baffle structure of claim 32 wherein the first direction is about perpendicular relative to the second direction.

34. The baffle structure of claim 32 wherein the first longitudinal axis has a first midpoint and the second longitudinal axis has a second midpoint and wherein the first midpoint is aligned with the second midpoint relative to a vertical axis.

35. The baffle structure of claim 31 wherein either the first layer or the second layer is non-rigid.

36. The baffle structure of claim 31 wherein both the first layer and the second layer is non-rigid.

37. The package of claim 11 wherein both the first dispensing orifice and the second dispensing orifice comprise a slit.

38. The package of claim 27 wherein both the first dispensing orifice and the second dispensing orifice comprise a slit.

* * * * *